United States Patent [19]

Oberth et al.

[11] 4,337,102

[45] Jun. 29, 1982

[54] HIGH ENERGY SOLID PROPELLANT COMPOSITION

[75] Inventors: Adolf E. Oberth, Fair Oaks; Howard A. Price, Folsom, both of Calif.

[73] Assignee: The United States of America as represented by the Secretary of the Air Force, Washington, D.C.

[21] Appl. No.: 118,008

[22] Filed: Feb. 4, 1980

[51] Int. Cl.[3] ..... C06B 45/10

[52] U.S. Cl. ..... 149/19.3; 149/19.6

[58] Field of Search ..... 149/19.3, 19.4, 19.6

[56] References Cited

U.S. PATENT DOCUMENTS

| | | | |
|---|---|---|---|
| 3,242,020 | 3/1966 | Atkins et al. | 149/19.6 |
| 3,454,436 | 7/1969 | Bedell | 149/19.6 |
| 3,523,840 | 8/1970 | Bedell | 149/19.4 |
| 3,529,042 | 9/1970 | Lippert | 149/19.4 |
| 3,531,339 | 9/1970 | Gilman et al. | 149/19.4 |
| 3,567,530 | 3/1971 | Lait et al. | 149/19.4 |
| 3,849,504 | 11/1974 | Mitsch | 149/19.3 |
| 4,023,994 | 5/1977 | Arendale | 149/19.4 |
| 4,116,131 | 9/1978 | Shafer et al. | 149/19.4 |
| 4,165,247 | 8/1979 | Brew et al. | 149/19.4 |

*Primary Examiner*—Edward A. Miller

*Attorney, Agent, or Firm*—Donald J. Singer; William J. O'Brien

[57] ABSTRACT

A system for improving the mechanical properties of high energy propellants utilizing solid poly(ethylene oxide) diol polymeric binders by adding minor amounts of soluble perchlorate salts to the propellant formulation.

6 Claims, No Drawings

HIGH ENERGY SOLID PROPELLANT COMPOSITION

STATEMENT OF GOVERNMENT INTEREST

The invention described herein may be manufactured and used by or for the Government for governmental purposes without the payment of any royalty thereon.

BACKGROUND OF THE INVENTION

This invention relates to novel compositions of matter which are useful as solid rocket propellants. In a more particular aspect, this invention concerns itself with a high energy solid propellant composition containing poly(ethylene oxide) diol as a propellant matrix or binder and a perchlorate additive material for use in improving the mechanical properties of such propellants.

The increased utilization of rockets, missiles and other propulsion devices has generated a considerable research effort in an attempt to provide more efficient propellant compositions. As is well known, the primary object in using a propellant is to impart motion to an object through the mechanism of a combustion reaction which transforms the propellant into a gaseous form. The mechanism by which this is accomplished varies for the different types and classes of propellants. One type of propellant which has been found very effective, is referred to as a composite type and is usually composed of an intimate mixture of a finely divided oxidizer uniformly distributed in a matrix of a plastic, resinous or elastomeric binder which also acts as a reductant-fuel for the propellant system.

Other ingredients may also be included as additives to improve ballistic or fabrication characteristics. For example, fillers, stabilizers, catalysts, burning rate modifiers, curing agents, plasticizers and ignition aids are often added to the propellant composition. Also, the propellants may contain additional fuels in the form of a finely divided metal, such as aluminum, magnesium, boron or beryllium.

The various ingredients making up the propellant formulation are blended and mixed thoroughly using conventional mixing equipment. The propellant is than formed into a desired shape by molding or extrusion followed by curing at room or elevated temperatures depending upon the formulation.

Among the more useful reductant fuels, or fuel binders, presently utilized in composite propellants, is the polymeric poly(ethylene oxide) diol, hereinafter referred to as PEG. This binder is generally used in combination with a high energy plasticizer such as bis-(2-fluoro-2, 2-dinitroethyl)-formal (FEFO) or (trimethylolethane) trinitrate (TMETN). Unfortunately, propellants of this type do not possess superior mechanical properties. However, with the present invention, it is now possible to produce high energy propellants with superior processing and mechanical behavior.

SUMMARY OF THE INVENTION

In accordance with this invention, it has been found that the addition of certain perchlorate additives to poly(ethyleneoxide) diol containing high energy propellants provides the propellants with superior mechanical properties. The particular perchlorate additives found to overcome the mechanical behavior problem of prior art propellants are selected from the group consisting of lithium perchlorate ($LiClO_4$) and magnesium perchlorate ($Mg(ClO_4)_2$).

Accordingly, the primary object of this invention is to provide an additive material capable of providing PEG containing propellants with superior mechanical properties.

Another object of this invention is to provide a mechanical behavior additive particularly adapted for use with high energy solid propellants.

Still another object of this invention is to provide a perchlorate additive material for improving the mechanical behavior characteristics of high energy solid propellant compositions.

The above and still other objects and advantages of the present invention will become more readily apparent upon consideration of the following detailed disclosure thereof.

DESCRIPTION OF THE PREFERRED EMBODIMENTS

Pursuant to the above-identified objects, the present invention concerns itself with certain perchlorate materials which have been found to be useful as additives for improving the mechanical behavior characteristics of high energy propellants containing a poly(ethylene oxide) diol polymer as a binder matrix.

Propellants employing a poly(ethylene oxide) polymer (PEG) matrix always exhibit better mechanical properties over propellants utilizing a poly(caprolactone) (PCP) backbone. This phenomenon is observed only when ammonium perchlorate (AP) is present in the propellant formulation. Unfilled binders or propellants not containing AP are stronger if (PCP) is used. This situation is depicted in Table I which discloses the effect that ammonium perchlorate has on the mechanical behavior characteristics in propellant compositions having a poly(ethylene oxide) diol polymer matrix or a poly(caprolactone) matrix in combination with a bis(-fluorodinitroethyL)-formal high energy plasticizer.

Tear energies listed are proportional to the area under the stress-strain curve, and provide a convenient parameter to compare relative propellant strengths.

TABLE I

EFFECT OF AP ON MECHANICAL PROPERTIES IN PEG-FEFO AND PCP/FEFO PROPELLANTS
Solids I - HMX-A 47.25%, 8μ AP 15.75%; Al 19%
Solids II - HMX-A 47.25%, 8μ HMX 15.75%; Al 19%

| | | Mechanical Properties at 77° F. | | | |
|---|---|---|---|---|---|
| Propellant Matrix | Type Solids | $\sigma_m$, psi | $\epsilon_m$, % | $E_o$, psi | Tear Energy psi |
| PEG/FEFO ½ | I | 103 | 30 | 476 | 19.3 |
| PEG/FEFO ½ | II | 108 | 13 | 934 | 7.1 |
| PCP/FEFO ½ | I | 93 | 25 | 530 | 14.9 |
| PCP/FEFO ½ | II | 94 | 23 | 562 | 13.4 |
| | Properties of the Unfilled Matrix | | | | |
| PEG/FEFO ½ | | 23 | 69 | 49 | 11 |
| PCP/FEFO ½ | | 45 | 227 | 50 | 116 |

The effect of AP on mechanical properties is reflected in its solubility in the respective propellant matrices. For example, PEG/FEFO at a ½ ratio (where FEFO is bis(fluorodinitroethyl)-formal, a high-energy plasticizer) dissolves 7.8% AP, while the mixture utilizing PCP does not dissolve detectable quantities of AP (less than 0.1%). While solubility is definitely a necessary requirement, it is not sufficient to produce the effect. A number of quaternary ammonium-perchlorates which are quite soluble in the binder matrices did not show any such effect as evidenced by the results disclosed in Table II. However, the addition of either lithium perchlorate ($LiClO_4$) or magnesium perchlorate ($Mg(ClO_4)_2$) was found to significantly improve the mechanical properties of the propellant even further than those obtained with ammonium perchlorate alone. The improvement achieved by using the perchlorate additives of this invention also is supported by the results disclosed in Table II.

Table III discloses the effect that lithium perchlorate ($LiClO_4$) exhibits on the propellant properties of a PEG/TMETN system which does not use ammonium perchlorate as an oxidizer component of the propellant formulation. In fact, quite small quantities of $LiClO_4$ have a pronounced effect on propellant mechanical properties as shown in Table III for a TMETN (trimethylolethane) trinitrate plasticized PEG/HMX propellant. In the absence of these perchlorates the propellant has poor elongation.

TABLE II

EFFECT OF METAL-PERCHLORATES ON PROPERTIES OF HIGH ENERGY PROPELLANTS
PEG/FEFO Matrix
Al, AP, HMX Filler, Total 82%

| Metal-Perchlorate 24% | Mechanical Properties at 77° F. | | | | |
|---|---|---|---|---|---|
| | $\sigma_m$, psi | $\epsilon_m$, % | $\epsilon_b$, % | $E_o$, psi | Tear Energy, psi |
| Control | 107 | 12 | 13 | 1500 | 9.7 |
| None | 97 | 43 | 44 | 308 | 24.1 |
| $LiClO_4$ | 111 | 47 | 50 | 345 | 32.0 |
| $Mg(ClO_4)_2$ | 123 | 39 | 42 | 470 | 32.5 |
| $[N(CH_3)_4]ClO_4$ | 95 | 41 | 45 | 327 | 24.7 |
| $[N(C_2H_5)_4]ClO_4$ | 101 | 34 | 37 | 420 | 21.8 |
| $[(CH_3)_3NCH_2CH_2N(CH_3)_3](ClO_4)_2$ | 93 | 37 | 40 | 401 | 24.7 |

*Control propellant in which the AP fraction of the oxidizer (15%) is replaced by HMX. All other formulations contain the AP.

TABLE III

EFFECT OF $LiClO_4$ ON PROPELLANT PROPERTIES IN ALL-HMX*, PEG/TMETN SYSTEM

| $LiClO_4$, % | Mechanical Properties at 77° F. | | | |
|---|---|---|---|---|
| | $\sigma_m$, psi | $\epsilon_m$, % | $E_o$, psi | Tear Energy, psi |
| 0.50 | 84 | 17 | 611 | 8.6 |
| 0.24 | 89 | 13 | 1441 | 6.9 |
| None | 130 | 7 | 3880 | 5.5 |
| 1.0 $N(et)_4ClO_4$ | 93 | 8 | 2627 | 4.5 |
| AP 12.6** | 87 | 23 | 480 | 12.1 |

*Solids:
Al H60 19.0%
HMX-A 12.6%
HMX 35μ 30.4%
HMX 3μ 20.0%
**Solids as above but 70μ AP instead of HMX-A.

Table IV discloses the effect of the use of lithium perchlorate ($LiClO_4$) on a propellant composition in which the plasticized binder is present in a two to one ratio. Table IV presents data that shows that lithium perchlorate ($LiClO_4$) in a TMETN/PEG propellant system containing some ammonium perchlorate still further improved mechanical properties, while again, the addition of quaternary ammonium perchlorates are ineffective.

A second, probably more important effect of the use of the soluble perchlorate salts of this invention is the prevention of phase separation (or plasticizer exudation) in the very important PEG/TMETN system. The PEG used in propellants is a solid which melts around 55° C. In the molten state it is miscible with TMETN (or FEFO) in all proportions. On cooling to room temperature, however, PEG crystallizes out and phase separation occurs. In the presence of as little as 2 weight percent AP or other effective compounds, the mixture remains a homogenious solution. Compounds that are effective in preventing phase separation include: AP, $LiClO_4$, $Mg(ClO_4)_2$, $Ca(ClO_4)_2$, $Ba(ClO_4)_2$, $Ph(ClO_4)_2$ $Zn(ClO_4)_2$, $Cd(ClO_4)_2$, $Fe(ClO_4)_3$, $ZnI_2$, LiI, $C_2H_5NH_3ClO_4$, $C_6H_{11}NH_3ClO_4$. However, because of hydrolytic instability of TMETN, particularly in an acidic environment, only AP and $LiClO_4$ are useful for propellant applications with this particular high energy plasticizer.

TABLE IV

EFFECT OF $LiClO_4$ ON PEG/TMETN PROPELLANTS
2/1 plasticizer/binder, 82% solids (4/1 HMX/AP)

| Additive | Conc. % | Mechanical Properties at 77° F. | | | | |
|---|---|---|---|---|---|---|
| | | $\sigma_m$, psi | $\epsilon_m$, psi | $\epsilon_b$, % | $E_o$, psi | Tear Energy, psi |
| None | — | 89 | 23 | 24 | 476 | 12.3 |
| $LiClO_4$ | 0.24 | 101 | 31 | 32 | 400 | 18.8 |
| $[N(CH_3)_4ClO_4$ | 0.24 | 86 | 31 | 33 | 391 | 15.0 |
| $[N(C_2H_5)]ClO_4$ | 0.24 | 87 | 29 | 31 | 401 | 14.6 |

The observed effects achieved by this invention are probably consistent with the mechanism in which the cation forms a complex with polyethyleneoxide which, due to ionic interactions, then produces a tougher matrix. In the ammonium perchlorates, the ammonium-hydrogens presumably form hydrogen-bonds with the ether-oxygens of the polymeric chain, while $Li^+$ and $Mg^{2+}$ probably form the usual coordination complexes. The role of the anion is that of providing the necessary solubility in the binder phase. Quaternary ammonium ions cannot form hydrogen-bonds, which explains their ineffectivity.

While the mechanism explained above is thought to be correct, at least in theory, it is not essential to the invention as a prerequisite to an understanding thereof. The invention, in essence, provides for an improvement of propellant mechanical properties by the incorporation of small quantities of a soluble perchlorate salt.

While the invention has been described with particularity in reference to specific embodiments thereof, it should be understood by those skilled in the art to which the subject matter of the present invention pertains, that the disclosure of the present invention is presented by way of illustration only, and that various alterations and modifications can be made without imposing limitations on the invention in any way, the scope of which is defined by the appended claims.

What is claimed is:

1. In a high energy solid propellant composition consisting essentially of:

a. a solid poly (ethylene oxide) diol, binder;

b. an inorganic oxidizer; and c. a high energy plasticizer, the improvement wherein a minor amount of a soluble perchlorate salt selected from the group consisting of lithium perchlorate and magnesium perchlorate is present in a dissolved state in said binder as a mechanical behavior improving additive.

2. A propellant composition as defined in claim 1 wherein said inorganic oxidizer is ammonium perchlorate.

3. A propellant composition as defined in claim 2 wherein said plasticizer is selected from the group consisting of (trimethylolethane) trinitrate and bis-(2-fluoro-2, 2-dinitroethyl)-formal.

4. A propellant composition as defined in claim 3 wherein said plasticizer is (trimethylolethane) trinitrate.

5. In a propellant composition as defined in claim 4 wherein said soluble perchlorate salt is lithium perchlorate.

6. In a propellant composition as defined in claim 3 wherein said plasticizer is bis-(2-fluoro-2, 2-dinitroethyl)-formal.

* * * * *